US008567944B2

(12) United States Patent
Swei

(10) Patent No.: US 8,567,944 B2
(45) Date of Patent: Oct. 29, 2013

(54) PRINTING METHOD

(75) Inventor: Jason Swei, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/435,166

(22) Filed: Mar. 30, 2012

(65) Prior Publication Data

US 2013/0257990 A1 Oct. 3, 2013

(51) Int. Cl.
*B41J 2/01* (2006.01)

(52) U.S. Cl.
USPC ..... 347/105; 347/101; 347/106

(58) Field of Classification Search
USPC ..... 347/101, 105, 106
See application file for complete search history.

(56) References Cited

U.S. PATENT DOCUMENTS

2011/0008542 A1* 1/2011 Zeng et al. ..... 427/288
2012/0105549 A1* 5/2012 Irving et al. ..... 347/54

* cited by examiner

*Primary Examiner* — Henok Legesse

(57) ABSTRACT

A printing method for producing durable images onto a printable recording medium is disclosed herein. The printing method encompasses providing a printable recording media; applying an ink composition containing a liquid vehicle and a colorant; wherein the print speed of the printing method is 50 fpm or higher. The printable recording media encompasses a base substrate, a first ink-receiving layer containing more than about 80 wt % of one or more particulate inorganic pigments and a second ink-receiving layer, on top of the first ink-receiving layer, including particulate inorganic pigments having an average particle size of about 0.1 to about 2 μm.

13 Claims, 1 Drawing Sheet

PRINTING METHOD

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including, low printer noise, capability of high-speed recording and multi-color recording. Inkjet web printing is a technology that is specifically well adapted for commercial and industrial printing. Though there has been great improvement in high-speed inkjet printing, improvements are followed by increased demands regarding higher resolution, increased durability and ability to print on specific recording substrates, specifically on glossy media.

BRIEF DESCRIPTION OF THE DRAWING

The drawings illustrate various embodiments of the present method and are part of the specification.

DETAILED DESCRIPTION

Figure 1:
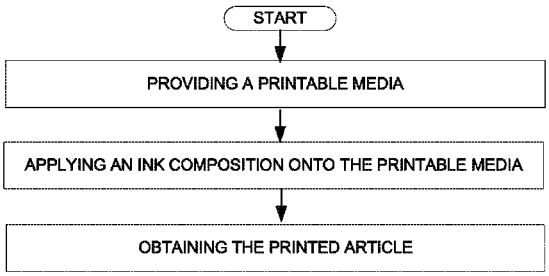
FIG. 1 is a flowchart illustrating the method for producing durable images according to some embodiments of the present disclosure.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

The present disclosure refers to a printing method for producing durable images onto a recording medium. The method encompasses providing a printable recording media; applying an ink composition containing a liquid vehicle and a colorant; wherein the print speed of the printing method is 50 fpm or higher. The printable recording media, used herein, encompasses a base substrate, a first ink-receiving layer containing at least 80 wt % of one or more particulate inorganic pigments; a second ink-receiving layer, on top of the first ink-receiving layer, including particulate inorganic pigments having an average particle size of about 0.1 to about 2 μm.

The image forming and printing method, described herein, provides printed images and articles that demonstrates high gloss, excellent image quality (good bleed and coalescence performance) and enhance durability performance while enabling high-speed and very high-speed printing. By high-speed printing, it is meant herein that the printing method can be done at a speed of 50 fpm or higher. As durability performance, it is meant herein that the resulting printed images are robust to dry and wet rubbing that can be done by going through finishing equipment (slitting, sheeting, folding, etc.) or by the user.

In addition, the image forming method described herein uses printable recording media that has, in the same time, an excellent gloss and a high absorptivity. The resulting printed article and image have, therefore, outstanding print durability and print quality. In some examples, the resulting printed images, obtained from the method described herein, have a high degree of gloss, good black optical density, excellent durability and print quality. High print density and color gamut volume are realized with substantially no visual color-to-color bleed and with good coalescence characteristics.

The Printing Method

The printing method for producing durable images includes providing a printable recording media that encompasses a base substrate; a first ink-receiving layer containing at least 80 wt % of one or more particulate inorganic pigments by total dry weight of the first ink-receiving layer; a second ink-receiving layer, applied on top of the first ink-receiving layer, containing particulate inorganic pigments having an average particle size of about 0.1 to about 2 μm; applying an ink composition containing a liquid vehicle and a colorant; the print speed of the printing method being more than about 50 fpm. In some examples, the ink composition is jetted onto the recording medium via inkjet nozzles.

In some examples, the printing method for producing durable images is an inkjet printing method. By inkjet printing method, it is meant herein a method wherein a stream of droplets of ink is jetted onto a recording substrate or medium to form the desired printed image. The ink composition may be established on the recording medium via any suitable inkjet printing technique. Examples of inkjet method include methods such as a charge control method that uses electrostatic attraction to eject ink, a drop-on-demand method which uses vibration pressure of a piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is jetted onto the recording medium using an inkjet nozzle and/or an inkjet printhead. In some other examples, the ink composition is jetted onto the recording method using thermal inkjet printheads.

The printing method described herein is a high-speed printing method. By high speed, it is meant a method capable of printing at a speed of more than 50 of feet per minute (fpm). In some examples, the web-speed could be from about 100 to about 4 000 feet per minute (fpm). In some other examples, the printing method is a printing method capable of printing from about 100 to about 1 000 feet per minute. In yet some other examples, the printing method is capable of printing at a web-speed of more that about 200 feet per minute (fpm).

In some example, the printing method is a high-speed web press printing method. As "web press", it is meant herein that the printing technology encompasses an array of inkjet nozzles that span the width of the paper web. The array is thus able, for example, to print on 20", 30", and 42" wide web or on rolled papers.

In some examples, the printing method as described herein prints on one-pass only. The paper passes under each nozzle and printhead only one time as opposed to scanning type printers where the printheads move over the same area of paper multiple times and only a fraction of total ink is use during each pass. The one-pass printing puts 100% of the ink from each nozzle/printhead down all at once and is therefore more demanding on the ability of the paper to handle all of the ink in a very short amount of time.

As mentioned above, a print medium in accordance with the principles described herein may be employed to print images on one or more surfaces of the print medium. In some examples, the method of printing an image includes depositing ink that contains particulate colorants. A temperature of the print medium during the printing process is dependent on one or more of the nature of the printer, for example. Any suitable printer may be employed such as, but not limited to, offset printers and inkjet printers. In some examples, the printer is a HP Edgeline® CM8060 printer (Hewlett Packard Inc).

The printed image may be dried after printing. The drying stage may be conducted, by way of illustration and not limitation, by hot air, electrical heater or light irradiation (e.g., IR lamps), or a combination of such drying methods. In order to achieve best performances, it is advisable to dry the ink at a maximum temperature allowable by the print medium that enables good image quality without deformation. Examples of a temperature during drying are, for examples, from about 90° C. to about 205° C., or from about 120° C. to about 180° C.

The printing method may further include a drying process in which the solvent (such as water), that can be present in the ink composition, is removed by drying. As a further step, the printable recording media can be submitted to a hot air drying systems. The printing method can also encompass the use of a fixing agent that will retain with the pigment, present in the ink composition that has been jetted onto the media.

An example of the printing method in accordance with the principles described herein, by way of illustration and not limitation, is shown in FIG. 1. FIG. 1 illustrates embodiments of the printing method that encompasses providing a printable recording media, applying an ink composition onto a printable recording media at high-speed printing and obtaining a printed article.

The Printable Recording Media

Figure 2:
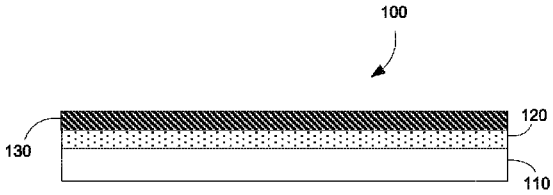
FIGS. 2 and 3 are cross-sectional views of printable the recording media according to embodiments of the present disclosure.
Figure 3:
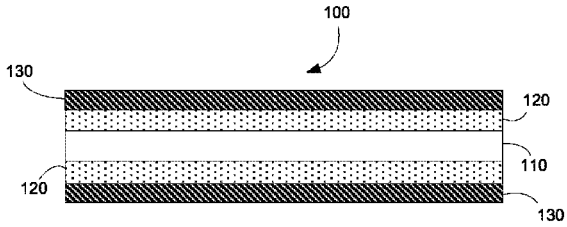

FIG. 2 and FIG. 3 illustrate the printable recording media (100) used in the printing method described herein. As illustrated in FIG. 2, the printable media (100) encompasses a bottom supporting substrate (110), a first ink-receiving layer (120) and a second ink-receiving layer (130). The first ink-receiving layer (120) is applied on one side of the bottom supporting substrate (110). The second ink-receiving layer (130) is applied over the first ink-receiving layer (120). If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In some examples, such as illustrated in FIG. 3, the first ink-receiving layer (120) and the second ink-receiving layer (130) are applied to both opposing sides of the supporting substrate (110). The double-side coated medium has thus a sandwich structure, i.e. both sides of the supporting substrate (110) are coated with the same coating and both sides may be printed.

In some examples, the printable recording media used herein is a coated glossy medium that can print at speeds needed for commercial and other printers such as, for example, a Hewlett Packard (HP) Inkjet Web Press (Hewlett Packard Inc., Palo Alto, Calif., USA). The properties of the print media in accordance with the principles described herein are comparable to coated media for offset printing.

In some examples, the printable recording media has a 75° gloss (sheet gloss) that is greater than 60%. In some other examples, that is greater than 65%. Such gloss is referred as the "Sheet Gloss" and measures how much light is reflected with a 75 degree (°) geometry on the unprinted recording media. 75° Sheet Gloss testing is carried out by Gloss measurement of the unprinted area of the sheet with a BYK-Gardner Micro-Gloss 75° Meter (BYK-Gardner USA, Columbia, Md., USA).

The printable recording media used in the method such as described herein encompasses a base substrate; a first ink-receiving layer containing more that about 80 wt % of one or more particulate inorganic pigments; a second ink-receiving layer, on top of the first ink-receiving layer, including particulate inorganic pigments having an average particle size of about 0.1 to about 2 μm.

The printable media has a fast absorption rate. By "fast absorption rate", it is meant that the water, solvent and/or vehicle of the ink can be absorbed by the media at a fast rate so that the ink composition does not have a chance to interact and cause bleed and/or coalescence issues. The absorption rate that defects free printing is dependent on the speed of the printing and amount of ink being used. The faster the printing speed and the higher the amount of ink used, the higher is the demand on faster absorption from the media. A good diagnostic plot with maximum ink density, especially secondary colors, would be prone to coalescence and a pattern of lines of all primary and secondary colors passing through area fills of primary and secondary colors would be prone to bleed. If no bleed or coalescence are present at the desired printing speed, the absorption rate would be sufficient. Bristow wheel measurements can be used for a quantitative measure of absorption on media wherein a fixed amount of a fluid is applied through a slit to a strip of media that moves at varying speeds.

The Base Substrate

As illustrated in FIG. 1, the printable media (100) used in the above mentioned printing method contains a bottom supporting substrate (110), a first ink-receiving layer (120) and a second ink-receiving layer (130). The printable media (100) contains a supporting substrate (110) that acts as a bottom substrate layer. The print medium substrate (i.e., 'substrate') contains a material that serves as a base upon which the first ink-receiving layer and the second ink-receiving layer are applied. The print medium substrate provides integrity for the resultant print medium. The material should have good affinity and good compatibility for the ink that is applied to the material.

Examples of substrates include, but are not limited to, natural cellulosic material, synthetic cellulosic material (such as, for example, cellulose diacetate, cellulose triacetate, cellulose propionate, cellulose butyrate, cellulose acetate butyrate and nitrocellulose), material including one or more polymers such as, for example, polyolefins, polyesters, polyamides, ethylene copolymers, polycarbonates, polyurethanes, polyalkylene oxides, polyester amides, polyethylene terephthalate, polyethylene, polystyrene, polypropylene, polycarbonate, polyvinyl acetal, polyalkyloxazolines, polyphenyl oxazolines, polyethylene-imines, polyvinyl pyrrolidones, and combinations of two or more of the above, for example. In some examples, the print medium substrate includes a paper base including, for example, paper, cardboard, paperboard, paper laminated with plastics, and paper coated with resin, for example.

The base substrate may be planar, either smooth or rough, or such other shape suitable for the particular purpose for which it is employed. The print medium substrate may be porous or non-porous, rigid, semi-rigid, or flexible, for example. Planar substrates may be in the form, for example, of a film, plate, board, a web or sheet by way of illustration and not limitation. In some embodiments, the base substrate is paper or coated paper.

The basis weight of the print medium substrate is dependent on the nature of the application of the print medium where lighter weights are employed for magazines and trifolds and heavier weights are employed for post cards, for example. In some examples, the print medium substrate has a basis weight of about 60 grams per square meter ($g/m^2$ or gsm) to about 400 gsm, or about 100 gsm to about 250 gsm.

The First Ink-Receiving Layer

The printable media contains a first ink-receiving layer (120). Without being limited by any theory, it is believed that the first ink-receiving layer is designed to provide a "high" absorption rate of the inks that is deposited thereon and to allow thus good bleed and coalescence performance. In some example, the first ink-receiving layer (120) is present on at least one side of the print medium substrate. In some other examples, the first ink-receiving layer (120) is present on both side of the print medium substrate.

The first ink-receiving layer (120) contains more than about 80 wt % of one or more particulate inorganic pigments by total dry weight of the first layer. The ink-receiving layer (120) can include inorganic pigments in particulate form and, at least, one binder.

A combination of a particle size and a coat-weight of the first ink-receiving layer on the printable recording media yield to effective pore sizes of the first ink-receiving layer in the range of about 0.008 microns (μm) to about 0.5 microns (μm). The phrase "effective pore size" refers to the pores that are formed by a particulate inorganic pigment associated with a print medium substrate. The effective pores are formed by a combination of an average particle size of the particulate inorganic pigment, a particle size distribution of the particulate inorganic pigment and a coat-weight of the particulate inorganic pigment. The phrase "particle size" refers to the diameter of a particle as if the particle were spherical. The phrase "average particle size" refers to the sum of all of the sizes of the particles divided by the total number of particles. The phrase "median particle size" refers to the particle size where 50 mass percent of the particles have a larger diameter and the other 50 mass percent have a smaller diameter.

The phrase "particle size distribution" refers to the percentage of particles falling within a particular size range. In some examples, about 65% to about 90%, or in some other examples, about 75% to about 85% of the particles have a certain particle size or particle size range. For purposes of illustration and not limitation, an example is a particle size distribution where about 75% to about 85% of the particles have a particle size in a range of about 1.0 to about 1.4 microns (μm).

In some examples, the average particle size (or the median particle size) of the particulate inorganic pigment, that are present in the first ink-receiving layer (120), is in the range of about 0.5 to about 10 microns (μm); in some other example, in the range of about 0.75 to about 2 μm, or, in yet some other example, in the range of about 1 to about 2 μm.

The particle size distribution applies to any of the average particle sizes or median particle sizes or particles size ranges set forth above for the particulate inorganic pigment of the first ink-receiving layer. For example, a particulate inorganic pigment with an average particle size of about 1.2 μm may have a particle size distribution where particles in the range of about 1 micron to about 4 μm are about 80 wt % of all of the particles of the pigment.

Without wishing to be held to any theory, it is believed that the particle size distribution should be such that the first ink-receiving layer combined with a second ink-receiving layer results in a coating having an effective pore size in the range of about 0.008 to about 0.5 μm. If the particle size distribution has too wide a range, then smaller particles will fill in the gaps between larger particles, resulting in an inability of obtaining the aforementioned effective pore size range.

In some examples, a combination of an average particle size and a coat-weight of the first ink-receiving layer yields an effective pore size in the range of about 0.008 μm to about 0.5 μm; or, in some other examples, yields an effective pore size in the range of about 0.01 μm to about 0.4 μm; or, in yet some other examples, yields an effective pore size in the range of about 0.05 μm to about 0.2 μm.

Particulate inorganic pigments suitable for the first ink-receiving layer, by way of illustration and not limitation, include calcined clay, ultra-fine precipitated calcium carbonate, modified calcium carbonate, and ground calcium carbonate, for example, with the above average particle size and particle size distribution. In some examples, in accordance with the principles described herein, the particulate inorganic pigment, by way of illustration and not limitation, is Kaocal® calcined clay (particle size distribution of about 83-92% particles finer than 2 μm) (from Thiele Kaolin Company, Sandersville Ga.); Omyajet® B5260 ultrafine precipitated calcium carbonate (average particle size of about 2.4 μm) (from Omya inc., Florence Vt.); or a mixture of Kaocal® calcined clay and Hydrocarb® 60 fine ground calcium carbonate (average particle size of about 1.5 μm) (from Omya inc.) wherein the mixture contains, by dry weight, at least about 50%, or at least about 80%, of Kaocal® calcined clay, for example.

In some examples, the particulate inorganic pigment, that are present in the first ink-receiving layer, are calcined clay, ultra-fine precipitated calcium carbonate, modified calcium carbonate, ground calcium carbonate, or combinations thereof. In some other examples, the particulate inorganic pigments, that are present in the first ink-receiving layer, are combinations of calcined clay and ground calcium carbonate.

The first ink-receiving layer may contain at least about 80 wt %, or at least 90 wt %, by dry weight of the first layer, of a particulate inorganic pigment such as, but not limited to, calcined clay, modified calcium carbonate, ground calcium carbonate, ultrafine precipitated calcium carbonate, and combinations of two or more thereof.

In some examples, the first ink-receiving layer further includes one or more polymeric binders in an amount representing from of about 2 wt % to about 20 wt % or, in some other example, in an amount representing from about 5 wt % to about 10 wt % by total dry weight of the first layer.

The polymeric binder may be, but is not limited to, latex polymers, polyvinyl alcohols and polyvinyl pyrrolidones. The latex polymer may be derived from a number of monomers such as, by way of example and not limitation, vinyl monomers, allylic monomers, olefins, and unsaturated hydrocarbons, and mixtures thereof. Classes of vinyl monomers include, but are not limited to, vinyl aromatic monomers (e.g., styrene), vinyl aliphatic monomers (e.g., butadiene), vinyl alcohols, vinyl halides, vinyl esters of carboxylic acids (e.g., vinyl acetate), vinyl ethers, (meth)acrylic acid, (meth)acrylates, (meth)acrylamides, (meth)acrylonitriles, and mixtures of two or more of the above, for example. The term "(meth) acrylic latex" includes polymers of acrylic monomers, polymers of methacrylic monomers, and copolymers of the aforementioned monomers with other monomers.

In some embodiments, the polymeric binder is a latex polymer binder. Examples of vinyl aromatic monomers that may form the latex polymeric binder include, but are not limited to, styrene, 3-methylstyrene, 4-methylstyrene, styrene-butadiene, p-chloro-methylstyrene, 2-chlorostyrene, 3-chlorostyrene, 4-chlorostyrene, divinyl benzene, vinyl naphthalene and divinyl naphthalene. Vinyl halides that may be used include, but are not limited to, vinyl chloride and vinylidene fluoride. Vinyl esters of carboxylic acids that may be used include, but are not limited to, vinyl acetate, vinyl butyrate, vinyl methacrylate, vinyl 3,4-dimethoxybenzoate, vinyl malate and vinyl benzoate. Examples of vinyl ethers that may be employed include, but are not limited to, butyl vinyl ether and propyl vinyl ether, for example. In some examples, the binder may be a styrene/butadiene latex copolymer. In some other examples, the binder may be a styrene/butadiene/acrylonitrile latex copolymer. The latex polymer can be, but is not limited to, Gencryl®9525 styrene/butadiene/acrylonitrile copolymer (from RohmNova, Akron Ohio), Gencryl®9750 styrene/butadiene/acrylonitrile (from RohmNova), STR 5401 styrene/butadiene (from Dow Chemical Company, Midland Mich.), Mowiol®4-98 polyvinyl alcohol (Kuraray America, Inc., Houston Tex.), for example, or a combination of two or more of the above.

Other components that may be present in a composition for forming a first ink-receiving layer in accordance with the principles described herein include one or more additives affecting various properties of the composition. The additives include, but are not limited to, one or more of rheology modifiers, surfactants or wetting agents, and dispersing agents, for example. The total amount by weight of additives in the composition for forming the first ink-receiving layer can be from about 0.1 wt % to about 2 wt %, or from about 0.2 wt % to about 1 wt %, by total dry weight of the first layer.

The Second Ink-Receiving Layer

As mentioned above, in the printable recording media in accordance with the principles described herein, a second ink-receiving layer is associated with the first ink-receiving layer, which may be on the first side or on the first side and the second side of the print medium substrate. Without being limited by any theory, it is believed that the second ink-receiving layer (or "topcoat layer") is designed to provide a high gloss to the media and to give good holdout of the ink that allow for high gamut, dark blacks, and excellent image gloss.

The second ink-receiving layer encompasses particulate inorganic pigments having an average particle size of about 0.1 to about 2 μm. In some examples, the second ink-receiving layer encompasses one or more particulate inorganic pigments and one or more of a polymeric binder. In some other examples, the second ink-receiving layer might further contain a surfactant, a rheology modifier, a dye, and/or an optical brightening agent.

The average particle size or the median particle size of the particulate inorganic pigment of the second ink-receiving layer can be in the range of about 0.2 to about 1.5 μm, or in the range about 0.4 to about 1 micron. The particle size distribution applies to any of the average particle sizes or median particle sizes or particles size ranges set forth above for the particulate inorganic pigment of the second ink-receiving layer. For example, by way of illustration and not limitation, a particulate inorganic pigment with an average particle size of about 1.2 μm may have a particle size distribution where particles in the range of about 1 micron to about 4 μm are about 80% of all of the particles of the pigment.

Particulate inorganic pigments suitable for the second ink-receiving layer, include clay, calcined clay, precipitated calcium carbonate, ground calcium carbonate, dolomite, aluminum silicate, mica, magnesium carbonate, silica, alumina, boehmite, talc, and combinations of two or more of the above, for example, with the above average particle size and particle size distribution set forth above. In some examples, the particulate inorganic pigment, that are present in the second ink-receiving layer, are calcium carbonate, calcined clay or kaolin clay.

The particulate inorganic pigment of the second ink-receiving layer, by way of illustration and not limitation, can be Omyaprime® HG30 calcium carbonate (average particle size of about 0.27 μm) (from Omya Inc.); Opacarb®A40 precipitated calcium carbonate (average particle size of about 0.4 μm) (from Specialty Minerals Inc., Bethlehem Pa.), Hydrafine® 90W fine clay (about 90%-96% particles finer than 2 μm) (from KaMin LLC, Sandersville Ga.); and combinations of the above, for example.

The second ink-receiving layer might further encompass a polymeric binder in an amount representing from about 2 wt % to about 20 wt %, or representing from about 4% to about 10%, by total dry weight of the second ink-receiving layer. The polymeric binder may be any one of the polymeric binders listed above for the first ink-receiving layer or combinations of two or more thereof. In addition, the composition for forming the second ink-receiving layer may include one or more of the additives mentioned above with regard to the composition for forming the first ink-receiving layer.

In some examples, both the first ink-receiving layer and the second ink-receiving layer encompass a polymeric binder, such as defined above, in an amount representing from about 2 wt % to about 20 wt % by total dry weight of each layer.

In some examples, the second ink-receiving layer can encompass one or more dyes such as, but not limited to, violet dye, for example. The amount of dye is sufficient or effective to enhance the color of the second ink-receiving layer. In some examples, the amount of dye is in the range of about 0.001 wt % to about 0.01 wt %, or in the range of about 0.005 wt % to about 0.01 wt % by total dry weight of the second ink-receiving layer. In some other examples, the second ink-receiving layer can encompass one or more optical brightening agents (OBA). The amount of OBA in the second ink-receiving layer is sufficient or effective to enhance the brightness of the second ink-receiving layer. The amount of OBA is in the range of about 0.01 wt % to about 0.5 wt %, or in the range of about 0.1 wt % to about 0.5 wt % by total dry weight of the second ink-receiving layer.

An amount of the first ink-receiving layer and an amount of the second ink-receiving layer on the print medium in the dry state is, at least, sufficient to hold all of the ink that is to be applied to the print medium. The supporting substrate (110) can have a thickness along substantially the entire length ranging between about 0.025 mm and about 0.5 mm.

In some examples, the first ink-receiving layer (120) is disposed on the supporting substrate (110) and forms a coating layer having a coat-weight which is in the range of about 2 to about 30 gram per square meter (g/m2 or gsm) per side, or in the range of about 5 to about 20 gsm, or of about 10 to about 15 gsm per side. In some other examples, the second ink-receiving layer (130) is disposed on the supporting substrate (110), above the first ink-receiving layer (120), and forms a coating layer having a coat-weight which is in the range of about 1 to about 30 gram per square meter (g/m2 or gsm) per side, or in the range of about 2 to about 10 gsm, or in the range of about 3 to about 9 gsm per side. In yet some other examples, the coat-weight of the first ink-receiving layer, on a side of the print medium substrate, is of about 5 to about 20 gsm and the coat-weight of the second ink-receiving layer on the same side of the print medium substrate, is of about 5 to about 20 gsm.

As mentioned above, the first ink-receiving layer is associated with the print medium. The phrase "associated with" means that a layer is, for example, formed on, coated on, adsorbed on or absorbed in at least one surface of the print medium substrate. The association between a layer and a surface of the print medium substrate is achieved by bringing the substrate and composition forming the layer into contact by, for example, spraying, dipping and coating (including, e.g., roll, blade, rod, slot die, or curtain coating). A composition with the components of the first ink-receiving layer is employed to form the first ink-receiving layer on the first side or on the first side and the second side of the print medium substrate. In some examples, the composition is an aqueous-based medium that contains one or more particulate inorganic pigments and one or more of a polymeric binder, a surfactant, a rheology modifier, a dye, and an optical brightening agent. The amount of each respective component mentioned above is present in the composition so that the resulting first ink-receiving layer in the dry state has the aforementioned amounts of the respective components.

In some examples, where the print medium substrate is base paper stock, the composition for forming the first ink-receiving layer can be applied on the base paper stock by an on-line surface size press process such as a puddle-sized press or a film-sized press, for example. In addition to on-line surface sizing processing, off-line coating technologies can also be used to apply the composition for forming the first ink-receiving layer to the print medium substrate. Examples of suitable coating techniques include, but are not limited to, slot die coaters, roller coaters, fountain curtain coaters, blade coaters, rod coaters, air knife coaters, gravure applications, and air brush applications, for example.

The Ink Composition

The method described herein encompasses applying an ink composition onto the above mentioned printable recording media, the ink composition including a liquid vehicle and a colorant. In some examples, the ink compositions are inkjet compositions; it means thus that the ink compositions are well adapted to be used in an inkjet device and/or in an inkjet printing process. The ink compositions may be established on the material via any suitable inkjet printing technique. Non-limitative examples of such inkjet printing technique include thermal, acoustic, continuous and piezoelectric inkjet printing.

In some examples, the ink composition used in the printing method described herein is an aqueous inkjet ink composition. The ink composition includes an aqueous liquid vehicle and a colorant. In some examples, the colorant is selected from a yellow colorant, a magenta colorant, a cyan colorant and a black colorant, and the ink vehicle includes at least one solvent present in an amount ranging from about 1 to about 25 wt %. The ink composition can also contain at least one surfactant present in an amount ranging from about 0.1 to about 8 wt %; at least one polymer present in an amount ranging from about 0 to about 6 wt %; at least one additive present in an amount up to about 0.2 wt %; and water by total weight of the ink composition. The colorant for each ink is selected from a pigment, a dye or combinations thereof. In some examples, the ink contains pigments as colorants. As used herein, "pigment" refers to a colorant particle that is substantially insoluble in the liquid vehicle in which it is used. Pigments can be dispersed using a separate dispersing agent, or can be self-dispersed, having a dispersing agent attached to the surface of the pigment. The pigments include both self-dispersed pigments as well as dispersed pigments, e.g., pigments dispersed by a separate dispersing agent that is not covalently attached to the surface.

As alluded to, pigment colorant can be used in accordance with embodiments of the present disclosure. Specifically, if black is used, the black pigment can be any commercially available black pigment that provides acceptable optical density and print characteristics. Such black pigments are commercially available from vendors such as Cabot Corporation, Columbian Chemicals Company, Evonik, Mitsubishi, and E.I. DuPont de Nemours and Company. In addition to black, other pigment colorants can be used, such as cyan, magenta, yellow, blue, orange, green, pink, etc. In some examples, the amount of colorants present in the ink compositions ranges from about 2.0 wt % to about 4.5 wt % by total weight of the ink composition.

As defined herein, an "ink vehicle" or "liquid vehicle" refers to the vehicle in which the colorant is placed to form the ink. A wide variety of ink vehicles may be used with the inks and printing methods according to embodiments disclosed herein. Non-limiting examples of suitable components for the ink vehicle include water-soluble polymers, anionic polymers, surfactants, solvents, co-solvents, buffers, biocides, sequestering agents, viscosity modifiers, surface-active agents, chelating agents, resins, and/or water, and/or combinations thereof. The solvents can be present in the ink vehicle in an amount ranging from about 5 wt % to about 20 wt % by total weight of the ink composition. The ink composition can include water. In some examples, the water makes up the balance of the ink composition, and may be present in an amount representing from about 40 wt % to about 90 wt % by total weight of the ink composition.

The surfactants, for the ink vehicle, can be nonionic or anionic. Suitable nonionic surfactants include, but are not limited to ethoxylated alcohols, fluorinated surfactants, 2-diglycol surfactants, and/or combinations thereof. Non-limiting examples of suitable anionic surfactants include surfactants of the Dowfax® family (e.g., Dowfax® 8390) manufactured by Dow Chemical Company or anionic Zonyl® surfactants (e.g., Zonyl® FSA) manufactured by E.I. DuPont de Nemours and Company. In some examples, the ink vehicle includes one or more surfactants and are present in an amount ranging from about 0.1 wt % to about 6 wt % by total weight of the ink composition.

In some examples, the ink vehicle can include a polymer present in an amount ranging from about 0.01 wt % to about 4 wt % by total weight of the ink composition. The polymers for the ink vehicle may be selected from those of the salts of styrene-(meth)acrylic acid copolymers, polystyrene-acrylic polymers, polyurethanes, and/or other water-soluble polymeric binders, and/or combinations thereof. As a non-limiting example, one class of polymeric binders suitable for use in the ink includes salts of styrene-(meth)acrylic acid copolymers. Other suitable additives include, but are not limited to, buffers, biocides, sequestering agents, chelating agents, or the like, or combinations thereof. In some examples, the ink vehicle includes one or more additives present in an amount ranging from about 0.1 wt % to about 0.5 wt % by total weight of the ink composition. In other examples, no additives are present.

EXAMPLES

Example 1

Printable Recording Media

A composition for forming a first ink-receiving layer on a raw base paper (76 gsm) is applied to both surfaces of the raw base paper at a coat-weight of about 15 gsm.

A composition for forming a second ink-receiving layer is applied over the first ink-receiving layer, to both surfaces of the media, at a coat-weight of about 6 gsm. The recording media is coated with the first and second ink-receiving layers using a bench top blade coater (from Euclid Coating Systems, Inc., Bay City Mich.) and is then calendered on pilot calender (Independent Machine Company, Fairfield N.J.) at 22063 kilo Pascals (kPa) (3200 pounds per square inch (psi)), 54.4° C. (130° F.), 2 passes. The media is dried with a heat gun for a period of 60 seconds.

The formulations of the different coating layers are expressed in the TABLE 1. Each number represents the parts of each component, present in each layer, based on 100 parts of inorganic pigments.

TABLE 1

| Layer of Media I | Ingredients | parts |
|---|---|---|
| First Ink-receiving layer | Kaocal ® | 60 |
| | Hydrocarb ® 60 | 40 |
| | GenCryl PT9525 | 8 |
| | Mowiol ® 4-98 | 1 |
| Coat-weight | | 15 gsm |
| Second Ink-receiving layer | Opacarb ® A40 | 85 |
| | Kaocal ® | 15 |
| | Omnova 2619AM | 7.5 |
| | Mowiol ® 4-98 | 0.5 |
| | Eka Flow ® L265 | 0.15 |
| | Leucophor T-100 | 0.08 |
| | Violet Cartaren 79732 | 0.0012 |
| | Deairex ® 03040 | 0.5 |
| Coat-weight | | 6 gsm |

Kaocal® is calcined clay available from Thiele Kaolin Company. Hydrocarb®60 is ground calcium carbonate available from Omya Inc. Mowiol®4-98 is polyvinyl alcohol available from Kuraray America Inc. Opacarb®A40 is precipitated calcium carbonate available from Specialty Minerals Inc. GenCryl®PT9525 is a latex from Omnova Solutions Inc. Omnova®2619AM is a latex from Omnova Solutions Inc. EkaFlow®L265 is rheology modifier available from Eka Chemicals. Leucophor®T-100 is an optical brightener available from Clariant. Violet Cartaren®79732 is a dye available from Clariant. Deairex®3040 is a defoamer available from Hercules Incorporated.

Example 2

Printing Method and Performances

An identical image sequence is printed on the media obtained in example 1 using a HP T350 Color Inkjet Web (Hewlett Packard Inc). Such printer contains HPA10 printheads filed with HPA10 inks. The web-speed for the printing process is about 400 fpm, no bonding agent is used. The settings on web press are "COLOR100_NORMAL_BOOK_V2__0 profile"; both dryers are set at 370° F. and 10,000 fpm air velocity.

Several tests and measurements are made on the resulting printed article (gamut, KOD, bleed, coalescence, absorption and 75° gloss). Such results are illustrated in Table 2. Comparative test are performed using a comparative media, i.e. commercially available inkjet web press medium, Newpage® Truejet™ Gloss print medium, from NewPage Corporation (Miamisburg, Ohio).

Gamut Measurement represents the amount of color space covered by the ink on the media. Gamut volume is calculated using L*a*b* values of 8 colors (cyan, magenta, yellow, black, red, green, blue, white) measured with an X-RITE®939 Spectro-densitometer (X-Rite Corporation), using D65 illuminant and 2° observer angle.

L*min value testing is carried out on a black printed area and is measured with an X-RITE®939 Spectro-densitometer, using D65 illuminant and 2° observer angle. This measure determines how "black" the black color is. A lower score indicates a better performance.

The black optical density (KOD) measures the reflectance of the area filled using an X-RITE®939 Spectro-densitometer. The higher the KOD value is, the darker the black colored image obtained.

The "Sheet Gloss" measures how much light is reflected with 75 degree geometry on an unprinted media. 75° Sheet Gloss testing is carried out by Gloss measurement of the unprinted area of the sheet with a BYK-Gardner MICRO-GLOSS® 75° Meter (BYK-Gardner USA). The "Image Gloss" measures the gloss of each color. 75° Image Gloss testing is carried out by Average 75° gloss measurement of 8 colors (cyan, magenta, yellow, black, red, green, blue, and white) measured with the BYK-Gardner MICRO-GLOSS® 75° Meter (BYK-Gardner). Image Gloss−Sheet Gloss represents the difference between average Image gloss of all colors minus sheet gloss. The higher the score (difference) is, the better the performance of the media is.

Bleed testing is carried out with a bleed stinger pattern. 1016 micron lines (or 40 mil, where 1 mil=$1/1000^{th}$ of an inch) of cyan, magenta, yellow, black, red, green, blue inks, passing through solid area fills of each color, are printed and scanned. The distance in μm is measured for how far each colored line bleeds or infiltrates into the area fill or vice versa. The max bleed of any color combination is reported.

TABLE 2

| MEDIA | Gamut | L * min | KOD | Sheet Gloss (75°) | Image Gloss (75°) | Image Gloss - Sheet Gloss | Bleed (mils) |
|---|---|---|---|---|---|---|---|
| Media (I) | 361848 | 10.1 | 1.92 | 65.6 | 94.6 | 29.0 | −3.3 |
| comparative media | 255854 | 19.9 | 1.51 | 48.6 | 52.5 | 3.9 | −3.7 |

Such data demonstrates that the printed method, described herein, enables high-speed printing and result in printed article demonstrating printing performances (excellent gamut, image gloss and good bleed performances).

The invention claimed is:

1. A printing method for producing a durable image comprising:

a. providing a printable recording media consisting of:

i. a base substrate;

ii. a first ink-receiving layer containing at least 80 wt % of one or more particulate inorganic pigments by total dry weight of the first ink-receiving layer, the particulate inorganic pigments in the first ink-receiving layer selected from the group consisting of calcined clay, ultra-fine precipitated calcium carbonate, modified calcium carbonate, ground calcium carbonate, and combinations thereof; and iii. a second ink-receiving layer, applied on top of the first ink-receiving layer, containing particulate inorganic pigments having an average particle size of about 0.1 μm to about 2 μm, the particulate inorganic pigments in the second ink-receiving layer selected from the group consisting of calcium carbonate, calcined clay, and kaolin clay; and b. applying an ink composition on the printable recording media, the ink composition comprising a liquid vehicle and a colorant;

c. wherein the print speed of the printing method 50 feet per minute (fpm) or higher.

2. The printing method of claim 1 wherein the ink composition is jetted onto the printable recording media via inkjet nozzles.

3. The printing method of claim 1 wherein the print speed of the printing method is more about 200 feet per minute (fpm).

4. The printing method of claim 1 wherein the printable recording media has a 75° sheet gloss that is greater than 60%.

5. The printing method of claim 1 wherein an average particle size of the particulate inorganic pigments present in the first ink-receiving layer is in the range of about 0.5 μm to about 10 μm.

6. The printing method of claim 1 wherein the particulate inorganic pigments, present in the first ink-receiving layer, are combinations of calcined clay and ground calcium carbonate.

7. The printing method of claim 1 wherein the first ink-receiving layer further comprises one or more polymeric binders in an amount representing from about 2 wt % to about 20 wt % by total dry weight of the first ink-receiving layer.

8. The printing method of claim 1 wherein the first ink-receiving layer of the printable recording media has effective pore sizes in the range of about 0.008 μm to about 0.5 μm.

9. The printing method of claim 1 wherein the second ink-receiving layer further comprises one or more of a polymeric binder.

10. The printing method of claim 1 wherein a coat-weight of the first ink-receiving layer, on a side of the printable recording media, is of about 5 gsm to about 20 gsm and a coat-weight of the second ink-receiving layer, on the same side of the printable recording media, is of about 5 gsm to about 20 gsm.

11. The printing method of claim 1 wherein both the first ink-receiving layer and the second ink-receiving layer comprise a polymeric binder in an amount representing from about 2 wt % to about 20 wt % by total dry weight of each layer.

12. The printing method of claim 1 wherein the first ink-receiving layer and the second ink-receiving layer are applied to both opposing sides of the base substrate.

13. A printed article resulting from the printing method according to claim 1.

* * * * *

UNITED STATES PATENT AND TRADEMARK OFFICE

CERTIFICATE OF CORRECTION

PATENT NO. : 8,567,944 B2
APPLICATION NO. : 13/435166
DATED : October 29, 2013
INVENTOR(S) : Jason Swei It is certified that error appears in the above-identified patent and that said Letters Patent is hereby corrected as shown below:

In the Claims:

In column 13, line 18, in Claim 1, delete “method” and insert -- method is --, therefor.

Signed and Sealed this
Eleventh Day of February, 2014

Michelle K. Lee

Michelle K. Lee
*Deputy Director of the United States Patent and Trademark Office*